United States Patent [19]

Hilton

[11] 4,398,358

[45] Aug. 16, 1983

[54] ATHLETIC SHOE

[75] Inventor: Carl W. Hilton, Muskegon, Mich.

[73] Assignee: Return on Investment Corporation, Muskegon, Mich.

[21] Appl. No.: 243,243

[22] Filed: Mar. 12, 1981

[51] Int. Cl.[3] ..... A43B 5/00; A43C 13/14

[52] U.S. Cl. ..... 36/114; 36/77 R

[58] Field of Search ..... 36/113, 114, 45, 77 R, 36/110

[56] References Cited

U.S. PATENT DOCUMENTS

| | | |
|---|---|---|
| 1,477,140 | 3/1923 | Lyons . |
| 1,757,575 | 5/1930 | Ishibashi . |
| 1,763,605 | 6/1930 | Haskell . |
| 1,855,452 | 4/1932 | Jones . |
| 1,986,580 | 1/1935 | Johnson . |
| 2,298,932 | 10/1942 | Ebling . |
| 2,327,415 | 8/1943 | Forschner . |
| 2,539,761 | 1/1951 | Whitman . |
| 2,806,300 | 9/1957 | Morgan, Jr. et al. . |
| 3,138,880 | 6/1964 | Kunzli . |
| 3,234,667 | 2/1966 | Bovay . |
| 3,618,235 | 11/1971 | Cary, Jr. . |
| 4,080,745 | 3/1978 | Torrance . |

*Primary Examiner*—Patrick D. Lawson

*Attorney, Agent, or Firm*—Price, Heneveld, Huizenga & Cooper

[57] ABSTRACT

An athletic shoe is disclosed which is primarily adapted for use in rapid start-stop sports, such as tennis, racquetball, handball and the like. The athletic shoe includes a sole, an upper secured to the sole and a toe cap which is secured to the sole and the upper. The toe cap defines a plurality of narrow slits which extend generally longitudinally of the sole. The narrow slits increase the flexibility of the toe cap and provide room for the toes of the user during rapid stops primarily to prevent bruising of the big toe.

12 Claims, 3 Drawing Figures

ATHLETIC SHOE

BACKGROUND OF THE INVENTION

The present invention relates to an athletic shoe and more particularly to a unique athletic shoe which prevents or limits injury to the big toe of the user.

A wide variety of shoes adapted for athletic use are presently available. Shoes employed in the playing of tennis, racquetball, handball and the like typically include a sole formed from a rubber or synthetic composition and which includes a configured gripping surface. Secured to the shoe is an upper which may be formed from leather or a synthetic material. Attached to the forward portion of the sole and also secured to the upper is a toe cap. A tongue extends rearwardly of the shoe from the toe cap. Such shoes may also include side bands or side reinforcement strips.

A common problem experienced by tennis players, racquetball players and the like is referred to as "black toe." During such athletic activity, the player will make frequent and rapid stops and starts. Quick stops cause the foot to shift forwardly in the shoe, which in turn can cause bruising or damage to the big toe. If the impact is sufficient, this ramming of the big toe into the front or toe cap portion of the shoe bruises or damages the toenail. This may result in a loss of the toenail. The player may lose the toenail and experience considerable pain during the rehabilitation process.

In order to prevent this problem, some athletes have worn shoes which are approximately one-half to one full size larger than actually required. The foot has room to shift during quick stops to prevent bruising of the big toe. Wearing of oversized shoes, however, may limit mobility and can cause the formation of callouses.

Another approach to preventing "black toe" is represented by U.S. Pat. No. 2,539,761, entitled ARTICLE OF FOOT WEAR and issued on Jan. 30, 1951, to Whitman. This patent discloses a canvas and rubber sports shoe which includes a foot retaining member composed of a pair of opposed straps. The shoe is constructed to prevent the foot of the wearer from slipping, sliding or creeping forward when the foot comes to a sudden stop. Upon a forward movement of the foot, the shoelaces tighten and the laces in turn tighten the opposed straps. This limits the forward motion of the foot. The straps are intended to prevent the big toe from impacting against the toe cap.

SUMMARY OF THE INVENTION

In accordance with the present invention, an improved athletic shoe is provided which results in increased room to accommodate the forward shifting foot and to prevent bruising or other damage to the big toe. Essentially, the athletic shoe includes a sole, an upper and a toe cap. A plurality of generally longitudinally extending narrow slits are formed in the toe cap. The slits increase the flexibility of the toe cap area. During sudden stops, the toe cap will in effect expand to provide additional room for the big toe to thereby prevent or limit bruising.

In narrower aspects of the invention, the slits are equally spaced transversely of the toe cap and extend generally longitudinally rearwardly and parallel to each other from the forward portion of the sole to a point immediately adjacent the shoe upper.

DETAILED DESCRIPTION OF THE PREFERRED EMBODIMENT

Figure 1:
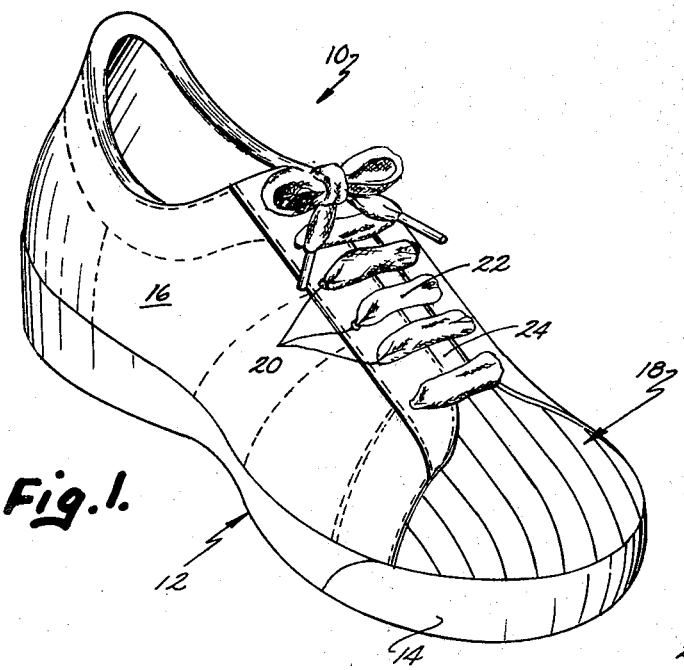
FIG. 1 is a perspective view of the athletic shoe in accordance with the present invention.

A preferred embodiment of the unique athletic shoe in accordance with the present invention is illustrated in FIG. 1 and generally designated 10. Shoe 10 includes a sole 12 having a forward end 14, an upper 16 which is attached to the lateral sides of sole 12, and a toe cap or vamp 18. Upper 16, as is conventional, defines a plurality of eyelets 20 which receive a lace 22. A tongue 24 is secured to the rear edge of the toe cap 18. The basic construction of the athletic shoe 10 is conventional. The sole 12 is typically formed from a rubber composition and includes a gripping surface 26. The upper and toe cap may be fabricated from leather, canvas or synthetic material and are typically sewn to each other and to the sole.

Figure 2:
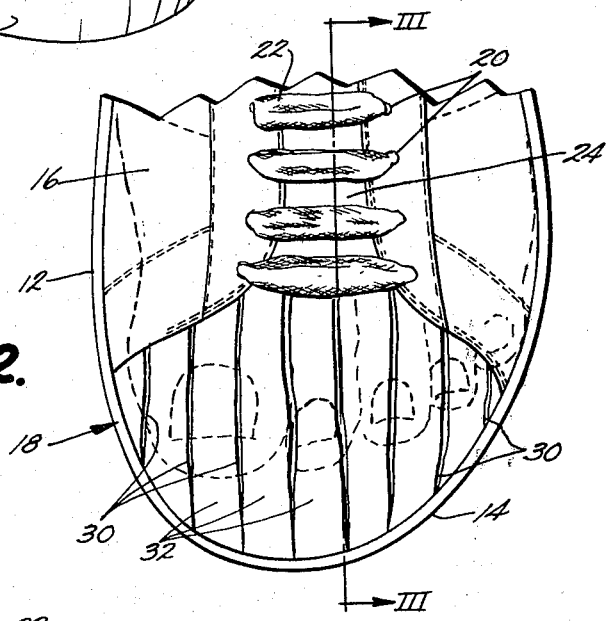
FIG. 2 is a fragmentary, top plan view thereof.
Figure 3:
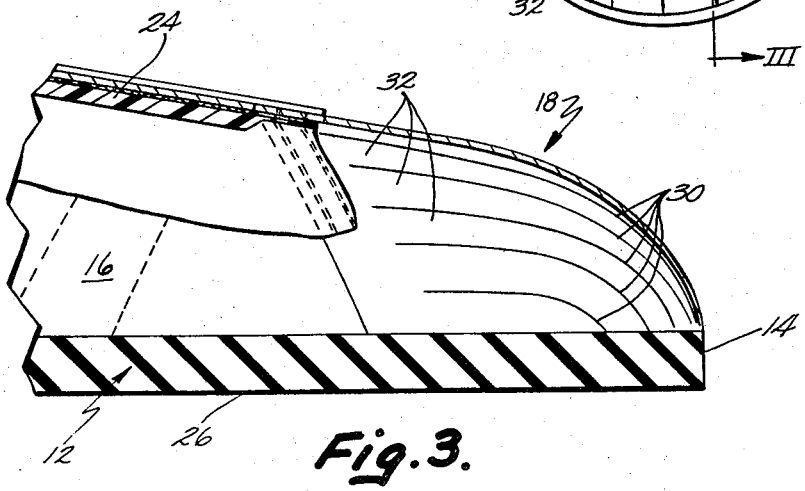
FIG. 3 is a cross-sectional view taken generally along line III—III of FIG. 2.

In accordance with the present invention, provision is made to increase the flexibility of the toe area of the shoe and permit this area to expand during sudden stops to accommodate a forward shifting of the foot. This expansion prevents or limits the severity of bruising or other damage to the big toe. As best seen in FIGS. 2 and 3, the toe cap 18 includes a plurality of cuts or slits 30. The cuts or slits 30 extend generally longitudinally of the sole 12. As illustrated, it is presently preferred that the slits extend from the forward portion 14 of the sole rearwardly substantially along the length of the toe cap 18. The slits extend parallel to each other and are substantially equally spaced transversely of the toe cap. The slits 30 are cut into the toe cap material with a suitable razor, knife or other sharp edged too. The toe cap 18, therefore, includes a plurality of straps 32 which extend longitudinally or rearwardly towards the upper 16. The slits 30 terminate immediately adjacent upper 16, as is clearly shown in FIG. 2.

When the user stops rapidly and the foot shifts forwardly, straps 32 will spread apart. This action provides increased space for the big toe of the user as the foot shifts forward within the shoe 10. This increase in toe space prevents bruising or damage to the big toe. The straps 32 are generally longitudinally extending areas which do not stretch or "give" but which are separated by means to permit them to spread apart or separate transversely of the toe cap. The separating means is defined by the slits or cuts.

In a presently existing embodiment of an athletic shoe in accordance with the present invention, the slits 30 are equally spaced transversely of the toe cap. Each strap 32 has a transverse or width dimension of approximately 0.30 inches.

The shoe in accordance with the present invention can increase its toe area and possesses increased flexibility. These increases are achieved without any adverse decrease in lateral stability of the shoe construction. The present invention may be readily incorporated into the presently existing athletic shoe designs which have heretofore been proposed for sports such as tennis, racquetball, handball and the like. Such existing shoes may be readily modified employing a razor-like tool to cut the parallel slits into the toe cap.

In view of the foregoing description, those of ordinary skill in the art will undoubtedly envision various modifications which will not depart from the inventive concepts disclosed herein. For example, the dimensioning of the straps 32 may be varied from the preferred embodiment described while still obtaining the benefits of increased flexibility and toe room expansion. Also, the straps could extend at an angle to the longitudinal centerline of the sole. The straps would still extend in a longitudinal direction from the front to the rear of the toe cap. The primary object is to provide a toe cap which will in effect spread apart transversely between "strap" areas to provide increased toe room. This result could possibly be accomplished by a material with longitudinal areas separated by portions which could stretch or expand transversely. Therefore, it is expressly intended that the above description should be considered as only that of the preferred embodiment. The true spirit and scope of the present invention may be determined by reference to the appended claims.

The embodiments of the invention in which an exclusive property of privilege is claimed are defined as follows:

1. An athletic shoe adapted for use in playing tennis, racquetball, handball and the like, said shoe comprising:

a sole;

an upper secured to the sole; and a toe cap secured to the sole and to the upper, said toe cap including a plurality of narrow slit means therein which extend generally longitudinally of said sole for causing said toe cap to spread apart transversely of said sole, provide increased toe room and reduce the chance of injury during sudden stops without an adverse decrease in lateral stability of the shoe.

2. An athletic shoe as defined by claim 1 wherein said slits extend parallel to one another and parallel to a longitudinal centerline of the sole.

3. An athletic shoe as defined by claim 1 wherein said slits extend rearwardly from a forward portion of said sole along said toe cap and substantially to said upper.

4. An athletic shoe as defined by claim 3 wherein said slits extend parallel to one another.

5. An athletic shoe as defined by claim 4 wherein said slits are substantially equally spaced transversely of said toe cap.

6. In an athletic shoe used in playing tennis, racquetball, handball and the like, the shoe being of the type including a sole defining a gripping surface, an upper secured to the sole, a toe cap secured to the sole and upper, and a tongue extending rearwardly from said toe cap, wherein the improvement comprises:

said toe cap defining a plurality of elongated strap areas which extend generally from a front end of the toe cap towards the upper, said toe cap including separating means inbetween said strap areas for permitting said strap areas to separate transversely to provide increased toe room and flexibility to reduce the chance of injury during sudden stops without an adverse decrease in lateral stability of the shoe.

7. In an athletic shoe as defined by claim 6 wherein said separating means comprises a plurality of cuts defined by said toe cap and extending generally longitudinally of said sole.

8. In an athletic shoe as defined by claim 7 wherein said cuts extend rearwardly along the toe cap from a forward portion of the sole and terminate immediately adjacent said upper, said cuts extending generally parallel to one another.

9. In an athletic shoe as defined by claim 8 wherein said cuts are substantially equally spaced transversely of said toe cap so that said toe cap is defined by a plurality of longitudinally extending straps.

10. In an athletic shoe as defined by claim 9 wherein each of said straps has a transverse dimension of approximately 0.30 inches.

11. A method of modifying an athletic shoe to limit damage to the big toe during sudden stops, the shoe being of the type including a sole, an upper secured to the sole and a toe cap secured to the sole and upper, said method comprising the step of:

cutting the toe cap to form a plurality of elongated, transversely spaced slits which extend rearwardly from a point adjacent a forward portion of the sole.

12. A method as defined by claim 11 wherein said cutting step includes the steps of forming said slits in parallel relationship to one another and spacing the slits substantially equally from one another transversely of said toe cap.

* * * * *